US010138682B2

(12) United States Patent
Mora et al.

(10) Patent No.: US 10,138,682 B2
(45) Date of Patent: Nov. 27, 2018

(54) TRI-FOOT, LADDER AND METHOD

(71) Applicants: Daniel C. Mora, Transfer, PA (US); Robert D. Beggs, Stoneboro, PA (US)

(72) Inventors: Daniel C. Mora, Transfer, PA (US); Robert D. Beggs, Stoneboro, PA (US)

(73) Assignee: Werner Co., Greenville, PA (US)

( * ) Notice: Subject to any disclaimer, the term of this patent is extended or adjusted under 35 U.S.C. 154(b) by 0 days.

(21) Appl. No.: 15/392,020

(22) Filed: Dec. 28, 2016

(65) Prior Publication Data

US 2018/0179821 A1 Jun. 28, 2018

(51) Int. Cl.
*E06C 7/46* (2006.01)
*E06C 7/42* (2006.01)
*E04G 5/02* (2006.01)

(52) U.S. Cl.
CPC ..... *E06C 7/42* (2013.01); *E06C 7/46* (2013.01); *E04G 5/02* (2013.01)

(58) Field of Classification Search
CPC ..... E06C 7/42; E06C 7/44; E06C 7/46; E04G 5/02
See application file for complete search history.

(56) References Cited

U.S. PATENT DOCUMENTS 1,243,844 A * 10/1917 Lofstrom ..... E06C 7/46 182/109
1,293,066 A * 2/1919 Faulkner ..... E06C 7/46 182/111
1,352,323 A * 9/1920 Johan ..... E06C 7/46 182/109
1,431,068 A * 10/1922 Waney ..... E06C 7/44 182/109
1,436,804 A * 11/1922 Hubbard ..... E06C 7/46 182/107
1,459,350 A * 6/1923 Veniero ..... E06C 7/46 182/108
1,496,201 A * 6/1924 Baxter ..... E06C 1/20 182/108
1,543,723 A * 6/1925 Rivitz ..... E06C 7/46 182/109
1,879,017 A * 9/1932 Babitt ..... E06C 7/46 182/111
1,973,226 A * 9/1934 Rose ..... E06C 7/46 182/109
2,163,970 A * 6/1939 White ..... E06C 7/46 182/111
2,277,939 A * 3/1942 Thalhammer ..... E06C 7/46 248/188.9

(Continued)

*Primary Examiner* — Daniel P Cahn
(74) *Attorney, Agent, or Firm* — Ansel M. Schwartz

(57) ABSTRACT

A ladder having a first rail having a bottom. The ladder having a second rail. The ladder having rungs attached to the first rail and second rail upon which a user climbs the ladder. The ladder comprises a ladder foot rotatably attached adjacent to the bottom of the first rail. The ladder foot having three distinct and different surfaces, with the first rail resting on one of the three surfaces at any one time the first rail is up right. The first rail changing to any of the three surfaces for the first rail to be upright upon by rotating the ladder foot. A method for placing a ladder. A ladder foot rotatably attached adjacent to a bottom of a first rail of a ladder. A method for making a ladder.

12 Claims, 1 Drawing Sheet

(56) References Cited

U.S. PATENT DOCUMENTS 2,309,484 A * 1/1943 Van Meter ..... E06C 7/46 182/109
2,407,575 A * 9/1946 Ramsey ..... E06C 7/46 182/110
2,503,626 A * 4/1950 Mayberry ..... E06C 7/44 182/111
2,567,989 A * 9/1951 Cheek ..... E06C 7/081 182/111
2,605,037 A * 7/1952 Smith ..... E06C 7/42 182/180.3
2,623,679 A * 12/1952 Agombar ..... E06C 7/46 182/109
2,691,479 A * 10/1954 Sharp ..... E06C 7/46 182/109
2,767,898 A * 10/1956 Cramer ..... E06C 7/46 182/109
3,805,917 A * 4/1974 Luther ..... E06C 7/44 182/200
4,304,318 A * 12/1981 Webb ..... E06C 7/44 182/107
4,699,247 A * 10/1987 Clarke ..... E06C 7/426 182/107
5,154,255 A * 10/1992 Kiska ..... E06C 7/46 182/111
5,522,473 A * 6/1996 Moselsky ..... E06C 7/44 182/111
5,908,085 A * 6/1999 Lovelady ..... E06C 7/44 182/111
5,918,698 A * 7/1999 Lunn ..... E06C 7/423 182/107
6,012,546 A * 1/2000 Bee ..... E06C 7/44 182/106
6,044,929 A * 4/2000 Wishner ..... E06C 7/426 182/200
7,803,031 B1 * 9/2010 Winckler ..... A63H 29/08 446/237
2004/0178617 A1 * 9/2004 Lagsdin ..... B60S 9/12 280/763.1
2007/0246301 A1 * 10/2007 Shaffer ..... E06C 7/44 182/201
2011/0017549 A1 * 1/2011 Lietz ..... E06C 1/06 182/172
2012/0175188 A1 * 7/2012 Xu ..... E06C 7/44 182/107
2012/0261214 A1 * 10/2012 Dondurur ..... E06C 7/183 182/106
2014/0001333 A1 * 1/2014 Stephen ..... E06C 7/46 248/530

* cited by examiner

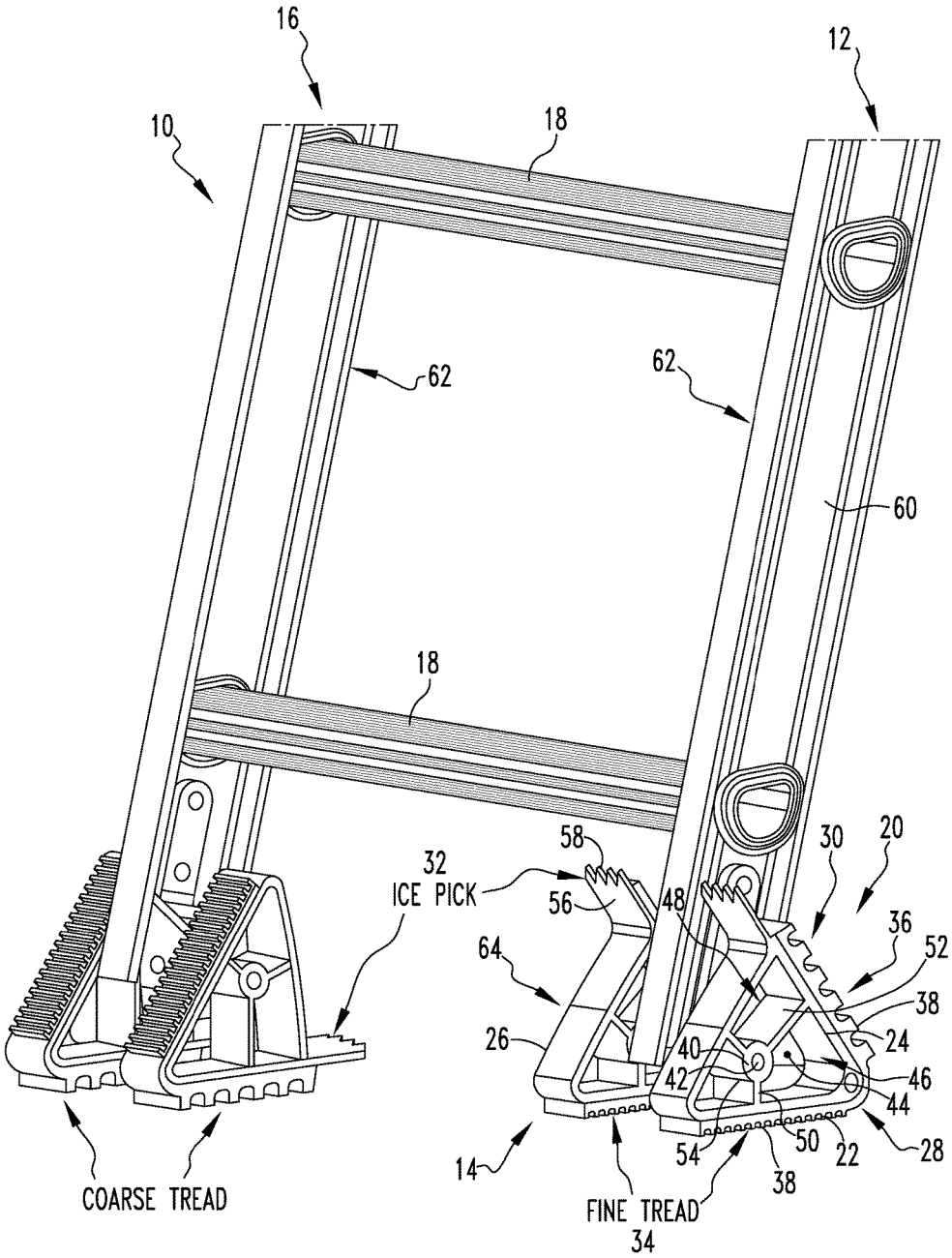
16
12
10
18
62
62
60
18
58
32
ICE PICK
56
48
30
20
36
52
64
38
26
40
24
42
46
44
54
50
22
28
14
38
COARSE TREAD
FINE TREAD
34

TRI-FOOT, LADDER AND METHOD

FIELD OF THE INVENTION

The present invention is related to a ladder foot having three distinct and different surfaces that can be rotated into position quickly, depending on the type of ground on which the ladder will be set upon. (As used herein, references to the "present invention" or "invention" relate to exemplary embodiments and not necessarily to every embodiment encompassed by the appended claims.) More specifically, the present invention is related to a ladder foot having three distinct and different surfaces that can be rotated into position quickly, depending on the type of ground on which the ladder will be set upon where the foot has a triangular-shaped with a fine tread for use on floors indoors, a course tread for use on ground outside, and a pick for insertion into the ground.

BACKGROUND OF THE INVENTION

This section is intended to introduce the reader to various aspects of the art that may be related to various aspects of the present invention. The following discussion is intended to provide information to facilitate a better understanding of the present invention. Accordingly, it should be understood that statements in the following discussion are to be read in this light, and not as admissions of prior art.

When using a ladder, it is always desirable to have as secure a placement on a floor or ground as possible. A ladder foot at the bottom of each rail of a ladder is commonly used to provide a more secure interface between the ladder and the floor or ground than the ladder rail itself can typically offer. The more surfaces that a ladder foot offers for the user to choose from to place the ladder upon, the more closely the surface can match the ground upon which the ladder will be placed. A ladder foot usually has only one or two surfaces available at a time to quickly position while attached to the ladder.

BRIEF SUMMARY OF THE INVENTION

The present invention pertains to a ladder. The ladder comprises a first rail having a bottom. The ladder comprises a second rail. The ladder comprises rungs attached to the first rail and second rail upon which a user climbs the ladder. The ladder comprises a ladder foot rotatably attached adjacent to the bottom of the first rail. The ladder foot having three distinct and different surfaces, with the first rail resting on one of the three surfaces at any one time the first rail is up right. The first rail changing to any of the three surfaces for the first rail to be upright upon by rotating the ladder foot.

The present invention pertains to a method for placing a ladder. The method comprises the steps of moving the ladder to a desired location. The ladder having a first rail and a second rail and rungs attached to the first rail and second rail upon which a user climbs the ladder. There is the step of rotating a ladder foot attached adjacent to a bottom of the first rail until one of three distinct and different surfaces of the ladder foot is facing ground. There is the step of setting the ladder onto the ground with the one of three distinct and different surfaces of the ladder foot resting on the ground when the ladder is upright.

The present invention pertains to a ladder foot rotatably attached adjacent to a bottom of a first rail of a ladder. The ladder foot comprises three distinct and different surfaces, with the first rail resting on one of the three surfaces at any one time the first rail is upright. The first rail changing to any of the three surfaces for the first rail to be upright upon by rotating the ladder foot. The ladder foot comprises a bolthole through which a bolt extends to rotatably attached the ladder foot to the first rail.

The present invention pertains to a method for making a ladder. The method comprises the steps of placing a bolt through a bolthole of a ladder foot having three distinct and different surfaces, with a first rail of the ladder resting on one of the three surfaces at any one time the first rail is upright. The first rail changing to any of the three surfaces for the first rail to be upright upon by rotating the ladder foot. There is the step of attaching the ladder foot to the first rail with the bolt.

BRIEF DESCRIPTION OF THE SEVERAL VIEWS OF THE DRAWING

In the accompanying drawings, the preferred embodiment of the invention and preferred methods of practicing the invention are illustrated in which:

FIG. 1 shows a ladder with a foot of the present invention.

DETAILED DESCRIPTION OF THE INVENTION

Referring now to the drawings wherein like reference numerals refer to similar or identical parts throughout the several views, and more specifically to FIG. 1 thereof, there is shown a ladder 10. The ladder 10 comprises a first rail 12 having a bottom 14. The ladder 10 comprises a second rail 16. The ladder 10 comprises rungs 18 attached to the first rail 12 and second rail 16 upon which a user climbs the ladder 10. The ladder 10 comprises a ladder foot 20 rotatably attached adjacent to the bottom 14 of the first rail 12. The ladder foot 20 having three distinct and different surfaces, with the first rail 12 resting on one of the three surfaces at any one time the first rail 12 is up right. The first rail 12 changing to any of the three surfaces for the first rail 12 to be upright upon by rotating the ladder foot 20.

The ladder foot 20 may essentially have the shape of a triangle with a first face 22, second face 24 directly connected to the first face 22, and a third face 26 directly connected to the first face 22 and second face 24. The first face 22 may have a first surface 28, the second face 24 has a second surface 30 different from the first surface 28, and the third face 26 has a pick 32 extending essentially perpendicular from it. The first surface 28 may be a fine rubber tread 34, and the second surface 30 may be a course rubber tread 36, where the course rubber tread 36 has larger and fewer grooves 38 per inch than the fine rubber tread 34 which has smaller and more grooves 38 than the course rubber tread 36.

The ladder foot 20 may have a bolthole 40 through which a bolt 42 extends to attach the ladder foot 20 to the first rail 12. The ladder foot 20 able to pivot about the bolt 42 so either the first, second or third surface can be chosen for the first rail 12 to rest upon. The triangular shape of the foot 20 may have a geometric center 44 and the bolthole 40 with the bolt 42 passing through the bolthole 40 offset from the geometric center 44. The bolthole 40 may be located in the triangular shape of the foot 20 closer to the face with the fine rubber tread 34 than the face with the course rubber tread 36 so the ladder foot 20 is taller relative to ground when the course rubber tread 36 is resting on the ground and enables a user to level the ladder 10 when the ladder 10 is set up on uneven ground by using the course tread on a face of the uneven ground which is lower than the fine tread on a face of the uneven ground on a second ladder foot 64 on the second rail 16 which is higher.

Each surface may be rectangular shaped, each face may be essentially flat, and the third surface may be essentially flat. The triangular shaped foot 20 may have an interior 46 with buttressing 48 that holds the bolthole 40. The buttressing 48 may include a first plate 50 extending into the interior 46 from the first face 22 to the bolthole 40, a second plate 52 extending into the interior 46 from the second face 24 to the bolthole 40, and a third plate 54 extending into the interior 46 from the third face 26 to the bolthole 40. The first plate 50 and third plate 54 our shorter than the second plate 52 so the bolthole 40 is held by the buttressing 48 offset from the geometric center 44 of the triangular shaped foot 20.

The pick 32 may have a first portion 56 that is rectangular shaped and directly extends from a top of the third face 26, and a second portion 58 that is serrated third directly extends from the first portion 56. The first rail 12 may have an outer face 60 and an inner face 62. The ladder foot 20 disposed on the outer face 60 of the first rail 12, and including a second ladder foot 64 rotatably attached to the inner face 62 with the bolt 42 that extends through the ladder 10. When there is a second ladder foot adjacent the first ladder foot, typically the first letter foot and the second ladder foot will have the same face positioned to contact ground.

The present invention pertains to a method for placing a ladder 10. The method comprises the steps of moving the ladder 10 to a desired location. The ladder 10 having a first rail 12 and a second rail 16 and rungs 18 attached to the first rail 12 and second rail 16 upon which a user climbs the ladder 10. There is the step of rotating a ladder foot 20 attached adjacent to a bottom 14 of the first rail 12 until one of three distinct and different surfaces of the ladder foot 20 is facing ground. There is the step of setting the ladder 10 onto the ground with the one of three distinct and different surfaces of the ladder foot 20 resting on the ground when the ladder 10 is upright.

The present invention pertains to a ladder foot 20 rotatably attached adjacent to a bottom 14 of a first rail 12 of a ladder 10. The ladder foot 20 comprises three distinct and different surfaces, with the first rail 12 resting on one of the three surfaces at any one time the first rail 12 is upright. The first rail 12 changing to any of the three surfaces for the first rail 12 to be upright upon by rotating the ladder foot 20. The ladder foot 20 comprises a bolthole 40 through which a bolt 42 extends to rotatably attach the ladder foot 20 to the first rail 12.

The present invention pertains to a method for making a ladder 10. The method comprises the steps of placing a bolt 42 through a bolthole 40 of a ladder foot 20 having three distinct and different surfaces, with a first rail 12 of the ladder 10 resting on one of the three surfaces at any one time the first rail 12 is upright. The first rail 12 changing to any of the three surfaces for the first rail 12 to be upright upon by rotating the ladder foot 20. There is the step of attaching the ladder foot 20 to the first rail 12 with the bolt 42.

This invention is preferably an extension ladder foot 20 which is shaped like a triangle. The foot 20 is oriented on the ladder base rail so that the triangle shape is observed when viewed from the side. One face of the triangular foot 20 engages the ground (or floor) at a time. Each of the three faces of the foot 20 has distinct features for engaging the ground: one face has a fine rubber tread 34, one face has a more coarse rubber tread, and one face has an "ice pick" feature. The foot 20 is able to pivot on the bolt 42 by which it is attached to the base rail in order for the user to bring any face of the foot 20 the user desires into ground contact.

The attachment/pivot bolt 42 does not pass through the geometric center 44 of the triangle shape but rather is closer to the face with the fine rubber tread 34 than the face with the coarse rubber tread. The foot 20 is therefore "taller" when the coarse tread is on the ground. This design feature enables the user to level the ladder 10 to some degree if it is set up on uneven ground by using the coarse tread face on the low face and the fine tread face on the high face.

The ladder foot 20 enables a user to quickly change the foot 20 contact surface to match the supporting surface condition. For instance, the fine tread for indoor use, coarse tread for outdoor use, and the ice pick 32 when it is necessary to dig into the supporting surface. The ladder foot 20 also enables the user to level the ladder 10 a small amount by using fine tread on one face and coarse tread on the other.

The width of each face is between 1 inch and 4 inches. The length of each face is between 3 inches and 8 inches. The thickness of each face is between ⅛ inch and ⅜ inch. The foot 20 is made of either aluminum steel or plastic. There is a space between half-inch and 2 inches between the first rail and the foot twenty. The length of the pick is between 1 inch and 4 inches and has the same width as the faces. The ladder when positioned upright on the first foot and the second foot is able to withstand a downward load of at least 600 lbs. without failing.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A ladder foot rotatably attached adjacent to a bottom of a first rail of a ladder comprising:

three surfaces that are distinct and different, and a bolthole through which a bolt extends to rotatably attach the ladder foot to the first rail, the ladder foot essentially has a shape of a triangle with a first face, second face directly connected to the first face, and a third face directly connected to the first face and second face, the first face has a first surface, the second face has a second surface different from the first surface, and the third face has a pick extending essentially perpendicular from it, the first surface is a first rubber tread, and the second surface is a second rubber tread, where the second rubber tread has larger and fewer grooves per inch than the first rubber tread which has smaller and more grooves per inch than the second rubber tread.

2. A ladder comprising:

a first rail having a bottom;

a second rail;

rungs attached to the first rail and second rail, the rungs configured to be climbed upon by a user to climb the ladder; and a ladder foot rotatably attached adjacent to the bottom of the first rail, the ladder foot having three surfaces that are distinct and different, with the first rail resting on the foot, with one of the three surfaces in contact with ground when the first rail is upright, any one of the three surfaces of the foot can be configured to contact the ground at one time by rotating the ladder foot, the ladder foot essentially has a shape of a triangle with a first face, second face directly connected to the first face, and a third face directly connected to the first face and second face, the first face has a first surface, the second face has a second surface different from the first surface, and the third face has a pick extending essentially perpendicular from it, the first surface is a first rubber tread, and the second surface is a second rubber tread, where the second rubber tread has larger and fewer grooves per inch than the first rubber tread which has smaller and more grooves per inch than the second rubber tread.

3. The ladder of claim 2 wherein the ladder foot has a bolthole through which a bolt extends to attach the ladder foot to the first rail, the ladder foot able to pivot about the bolt so either the first, second or third surface can be chosen to rest upon, ground.

4. The ladder of claim 3 wherein the foot has a geometric center in the bolt hole with the bolt passing through the bolthole offset from the geometric center.

5. The ladder of claim 4 wherein the bolthole is located in the foot closer to the first face with the first rubber tread than the second face with the second rubber tread so the ladder foot is taller relative to ground when the second rubber tread is on ground and enables a user to level the ladder when the ladder is set up on uneven ground by using the second face on the uneven ground which is lower than the first face on the uneven ground on a second ladder foot on the second rail which is higher.

6. The ladder of claim 5 wherein each surface is rectangular shaped, each face is essentially flat, and the third surface is essentially flat.

7. The ladder of claim 6 wherein the foot has an interior with buttressing that holds the bolthole.

8. The ladder of claim 7 wherein the buttressing includes a first plate extending into the interior from the first face to the bolthole, a second plate extending into the interior from the second face to the bolthole, and a third plate extending into the interior from the third face to the bolthole, the first plate and third plate shorter than the second plate so the bolthole is held by the buttressing offset from the geometric center of the foot.

9. The ladder of claim 8 wherein the pick has a first portion that is rectangular shaped and directly extends from a top of the third face, and a second portion that is serrated and directly extends from the first portion.

10. The ladder of claim 9 wherein the first rail has an outer face and an inner face, the ladder foot is disposed on the outer face of the first rail, and including a second ladder foot rotatably attached to the inner face with the bolt.

11. A method for placing a ladder comprising the steps of:

moving the ladder to a desired location, the ladder having a first rail and a second rail and rungs attached to the first rail and the second rail, the rungs configured to be climbed upon by a user to climb the ladder;

rotating a ladder foot attached adjacent to a bottom of the first rail until one of three surfaces that are distinct and different of the ladder foot is facing ground, the ladder foot essentially has a shape of a triangle with a first face, second face directly connected to the first face, and a third face directly connected to the first face and second face, the first face has a first surface, the second face has a second surface different from the first surface, and the third face has a pick extending essentially perpendicular from it, the first surface is a first rubber tread, and the second surface is a second rubber tread, where the second rubber tread has larger and fewer grooves per inch than the first rubber tread which has smaller and more grooves per inch than the second rubber tread; and setting the ladder onto the ground with the one of three surfaces of the ladder foot resting on the ground and the ladder is upright.

12. A method for making a ladder comprising the steps of:

placing a bolt through a bolthole of a ladder foot having three surfaces that are distinct and different; and attaching the ladder foot to the first rail with the bolt, the ladder foot essentially has a shape of a triangle with a first face, second face directly connected to the first face, and a third face directly connected to the first face and second face, the first face has a first surface, the second face has a second surface different from the first surface, and the third face has a pick extending essentially perpendicular from it, the first surface is a first rubber tread, and the second surface is a second rubber tread, where the second rubber tread has larger and fewer grooves per inch than the first rubber tread which has smaller and more grooves per inch than the second rubber tread.

* * * * *